US006817663B1

(12) United States Patent
Stuart

(10) Patent No.: US 6,817,663 B1
(45) Date of Patent: Nov. 16, 2004

(54) HIGHCHAIR COVER

(76) Inventor: Joslyn B. Stuart, 1666 Larkfield Ave., Thousand Oaks, CA (US) 91362

( * ) Notice: Subject to any disclaimer, the term of this patent is extended or adjusted under 35 U.S.C. 154(b) by 0 days.

(21) Appl. No.: 10/414,734

(22) Filed: Apr. 15, 2003

Related U.S. Application Data

(60) Provisional application No. 60/379,478, filed on May 7, 2002.

(51) Int. Cl.[7] ..... A47C 31/00

(52) U.S. Cl. ..... 297/219.12; 297/219.1; 297/227; 297/228

(58) Field of Search ..... 297/219.12, 227, 297/228, 219.1

(56) References Cited

U.S. PATENT DOCUMENTS 1,704,346 A * 3/1929 Schneider ..... 280/7.1
2,254,466 A * 9/1941 Albert ..... 297/225
4,885,200 A * 12/1989 Perdelwitz et al. ..... 428/136
4,993,090 A * 2/1991 Ranalli ..... 5/482
5,678,888 A * 10/1997 Sowell et al. ..... 297/256.17
5,833,309 A * 11/1998 Schmitz ..... 297/180.11
5,897,164 A * 4/1999 Kagan et al. ..... 297/219.12
6,394,543 B1 * 5/2002 Dunne et al. ..... 297/219.12
6,428,098 B1 * 8/2002 Allbaugh ..... 297/219.12
2001/0048235 A1 * 12/2001 Hartranft ..... 297/219.12

* cited by examiner

*Primary Examiner*—Peter M. Cuomo
*Assistant Examiner*—Sarah C. Burnham
(74) *Attorney, Agent, or Firm*—Thomas I. Rozsa; Tony D. Chen

(57) ABSTRACT

A one-piece highchair cover made out of washable fabric material such as nylon and which is designed to fit over and be retained on a highchair by having side openings to accommodate the respective side arms and/or highchair tray of the highchair, openings to accommodate a fastening means such as a seatbelt to retain the highchair cover on the highchair, and a stretchable rear fastening means such as a strap to retain the back portion of the highchair cover on the highchair, all of which enables the highchair to be fully protected and covered while permitting the baby to aggressively move around in the highchair while being fed and insures that the highchair cover will remain in its position and not expose a portion of the highchair or fall off the highchair during the feeding process. The washable fabric material also enables the removable highchair cover to be easily removed from the highchair so that it can be washed for subsequent use.

16 Claims, 4 Drawing Sheets

HIGHCHAIR COVER

This application claims priority based on Provisional Application 60/379,478 filed in the United States on May 7, 2002.

BACKGROUND OF THE INVENTION

1. Field of the Invention

The present invention generally relates to the field of covers for furniture items and in particular, covers for furniture items used with babies.

2. Description of the Prior Art

Feeding a baby is a messy process because the baby frequently refuses food fed to the baby so the food may spill out of the spoon and fall on a furniture item in which the baby is seated. The baby also frequently spits out or regurgitates the food so that it falls on the furniture item in which the baby is sitting or falls on the floor. Babies also typically like to play with their food and will throw it on the floor or on a furniture item. Most commonly, a parent tries to feed the baby when the baby is seated in a highchair. In an attempt to protect the highchair from the spilled food, a parent places a towel or cloth covering on the highchair or on various portions of the highchair including the seat and the back. The problem with such coverings is that they are not properly fastened to the highchair and as the baby moves around in the highchair, the cover either is moved to expose a portion of the highchair or falls off entirely.

Therefore, there is a significant need for an apparatus which can cover the highchair in an effective manner while a baby is being fed so that the cover remains on the highchair even when the baby is moving around in the highchair.

SUMMARY OF THE INVENTION

The present invention is a one-piece highchair cover made out of washable fabric material such as nylon and which is designed to fit over and be retained on a highchair by having side openings to accommodate the respective side arms and/or highchair tray of the highchair, additional openings to accommodate a fatening means such as a seatbelt to retain the baby on the seat cover and in the highchair, and a stretchable rear fastening means such as a strap to retain the back portion of the highchair cover on the highchair, all of which enables the highchair to be fully protected and covered while permitting the baby to aggressively move around in the highchair while being fed and insures that the highchair cover will remain in its position and not expose a portion of the highchair or fall off the highchair during the feeding process. The washable fabric material also enables the removable highchair cover to be easily removed from the highchair so that it can be washed for subsequent use.

The highchair cover comes in three sizes—small, medium and large—to accommodate different sizes of highchairs.

It has been discovered, according to the present invention, that if a highchair cover is designed with a pair of openings to permit the respective arms of the highchair to fit through the cover and is further designed with an additional group of openings to permit a seatbelt or other fastening means to fasten the highchair cover to the highchair, and/or fasten the baby to the highchair cover, then the highchair cover will remain on the highchair even while a baby is engaged in vigorous activity during the feeding process and the baby will remain in the highchair.

It has further been discovered, according to the present invention, that if a stretchable strap is designed into the rear portion of the highchair cover, the stretchable strap will enable the highchair cover to remain on the upper portion of the highchair and on the back of the highchair even while the baby is engaged in vigorous activity during the feeding process.

It has further been discovered, according the present invention, that if a stretchable elastic is sewn into the upper portion of the highchair cover, it will enable the highchair cover to be fit over the upper portion of the highchair and further remain in place so that the highchair cover will not fall off the upper portion of the highchair cover while the baby is aggressively moving in the highchair during the feeding process.

It has further been discovered, according to the present invention, that if the highchair cover is designed to be of sufficient size to cover an excessive portion of the seat portion and upper portion of the highchair cover as well as the arms of the highchair, it can accommodate any multiplicity of highchair cover shapes and sizes so that one size highchair cover can be used to cover any desired highchair presently on the market today.

It has further been discovered, according to the present invention, that if the highchair cover is made out of flexible washable synthetic material, preferably neoprene, nylon, polyester, etc., then the highchair cover can easily be sized to fit over any desired highchair and retained in the highchair as previously discussed while at the same time being easily removable from the highchair when the feeding process is completed so that the highchair cover can be washed to remove any food, urine or other substances that have soiled the highchair cover during the feeding process and can be easily replaced on the highchair for the next feeding of the baby.

It has further been discovered according to the present invention that with the highchair cover design as discussed above, the highchair cover will remain in place while the baby is being fed and will not fall off the highchair or expose any portion of the highchair to any food or any excrement or any other soiling which the baby may create during the feeding process.

It is therefore an object of the present invention to create a highchair cover which can be designed to fit over any size highchair or any shape highchair and protect the highchair during the process of feeding a baby.

It is a further object of the present invention to create a highchair cover which has appropriate openings so that the highchair cover can fit through the side arms of the highchair and also can be fastened to the highchair by fastening means such as a seatbelt and further retained on the highchair by a stretchable strap means so that the highchair cover will remain in place during the vigorous feeding process.

It is a further object of the present invention to provide a washable and reusable highchair cover which can be easily removed from the highchair after the feeding process is completed, washed and thereafter returned to the highchair so that the highchair cover will once again remain in its operative position during the time the baby is being fed.

It is a further object of the present invention to create a highchair cover of sufficient size and styling so that it can fit over any desired highchair on the market today and be retained in place during the vigorous feeding process.

It is an additional object of the present invention to provide a highchair cover which will protect the highchair and the surrounding area during the feeding process so that any food which is either spilled by the baby or regurgitated or spit out by the baby or thrown out by the baby will land on the highchair cover and not on the highchair.

It is a further object of the present invention to provide a removable and reusable highchair cover which is made of material which permits the highchair cover to be easily washed and cleaned so that it can be used numerous times and will not fade or shrink during the washing and cleaning process.

It is another object of the present invention to make the highchair cover out of a decorative and attractive color so that the highchair cover will also serve to be an attractive visual stimulus for the baby to induce the baby to eat during the feeding process.

It is also an object of the present invention to create a highchair cover which is made of synthetic polyester material or other reusable washable material which can be easily cleaned and will not fade in color and will not shrink during the numerous washing processes after each feeding.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
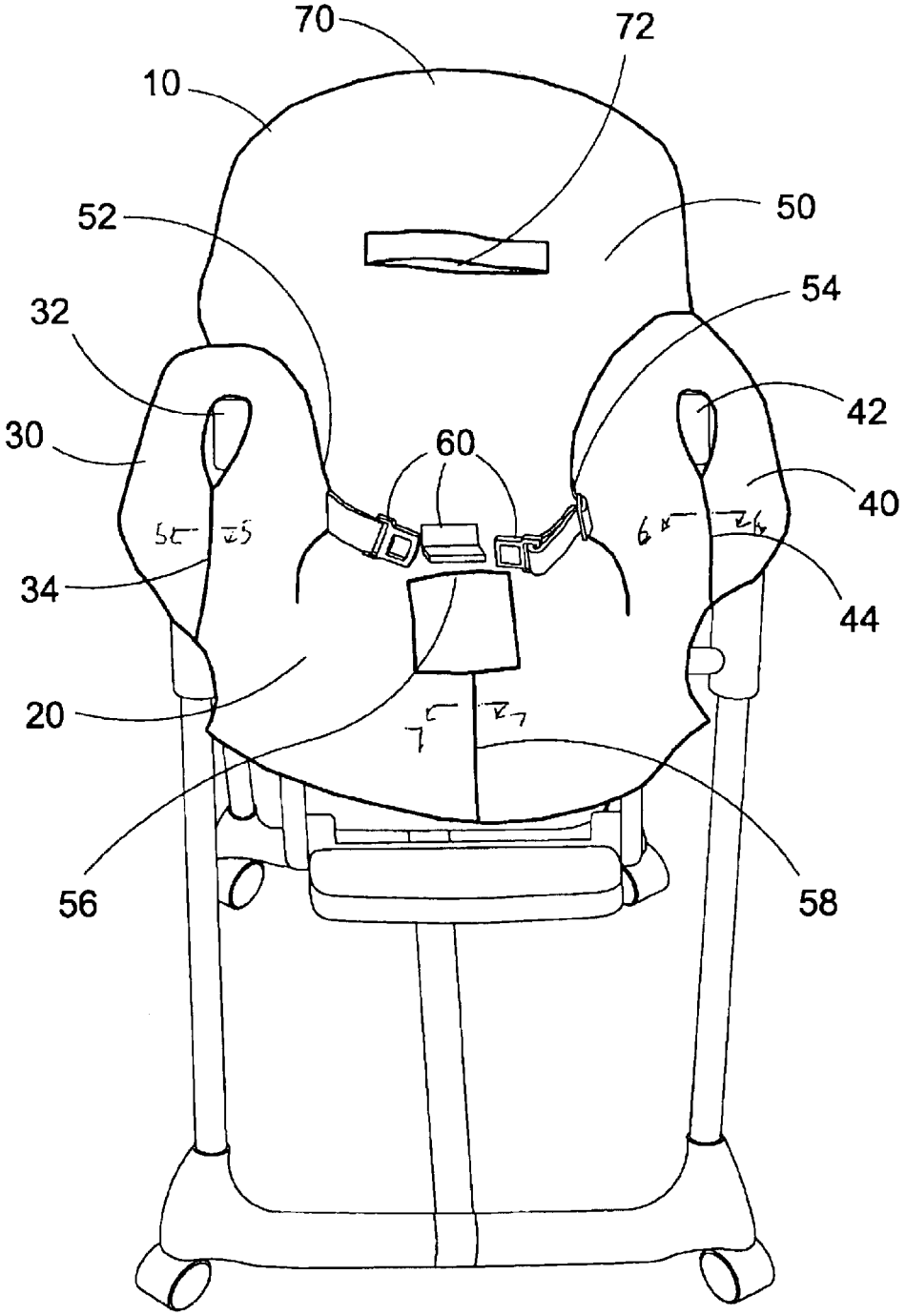
FIG. 1 is a front elevational view of the present invention highchair cover placed in its operative position on a highchair.
Figure 2:
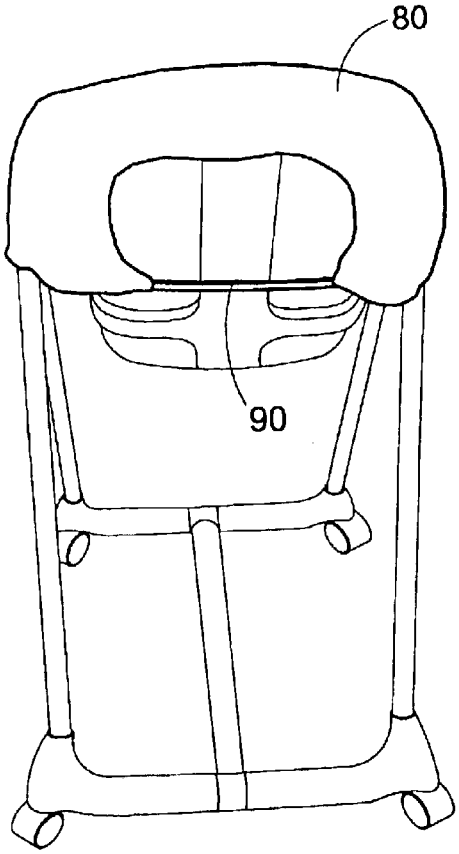
FIG. 2 is a rear elevational view of the present invention highchair cover placed in its operative position on a highchair.
Figure 3:
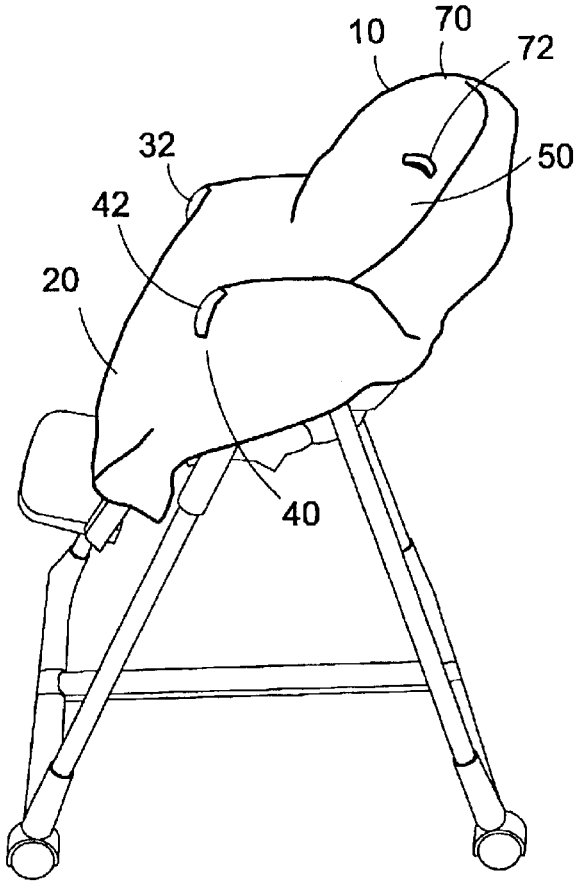
FIG. 3 is a side elevational view of the present invention highchair cover placed in its operational position on a highchair.

Referring to FIGS. 1 through 3, there is shown the present invention highchair cover in its operative position on a highchair from a front perspective view, a rear perspective view, and a side elevational view with the other opposite side being a mirror image. The highchair cover 10 is made of one-piece construction and is made of washable material which by way of example, can be nylon, rip-stop nylon (comparable to the material which parachutes are made of), polyester, rayon, or any other synthetic material. It will be appreciated that the present invention can also be made out of other material such as cloth material such as cotton as long as it can frequently be rewashed without fading and without shrinking.

The present invention highchair cover 10 as illustrated is designed to fit entirely over the highchair including the seat portion, the arms and the back portion of the highchair as illustrated in FIGS. 1 through 3 so that the entire highchair cover is completely covered during the feeding process and at the same time will not expose any portion of the furniture or fall off the furniture during the time the baby is aggressively moving around in the highchair while being fed. The highchair cover also is comfortable to sit in so that the baby will feel comfortable during the feeding process and also does not take up a large amount of space within the highchair so that the baby can be comfortably seated in the highchair during the feeding process.

Figure 5:
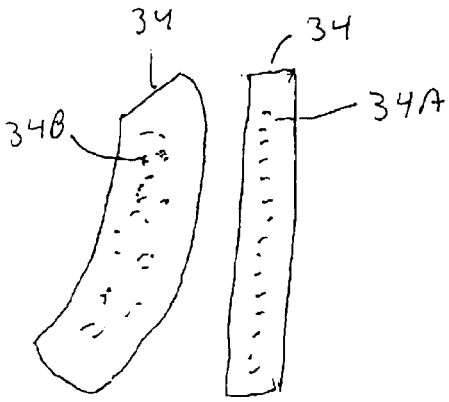
FIG. 5 is cross-sectional view taken along Line 5—5 of FIG. 1.
Figure 6:
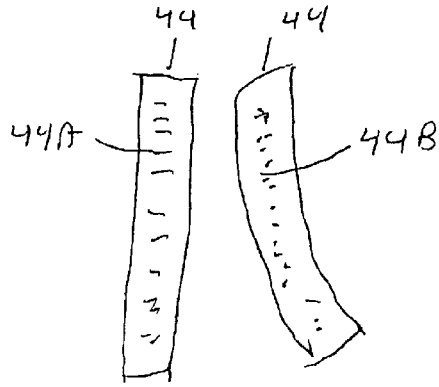
FIG. 6 is a cross-sectional view taken along Line 6—6 of FIG. 1.

The one-piece highchair cover comprises a lower portion 20 which is designed to fit over the seat of the highchair cover and extend in front of the seat of the highchair cover as illustrated in FIG. 1. The one-piece highchair cover also contains a first side member 30 having a first opening 32 and a second side member 40 having a second side opening 42 so that the side members can fit over the arms of the highchair as illustrated with a first arm of the highchair extending through opening 32 and a second arm of the highchair fitting through second opening 42 as illustrated in FIG. 1 so that the side portions 30 and 40 respectively cover both the interior and exterior sides of the highchair as illustrated in FIG. 1. In addition, first side member 30 contains a seam 34 having a pair of mating fastening members to openably attach the respective sections of the seam to one another so that the entire side section can be opened to more conveniently fit the opening 32 through the arm of the highchair. Referring to the exposed view of FIG. 5, the mating sections of the fastening members are illustrated as 34A and 34B located on opposite sections of the highchair cover 10 at the location of seam 34. This is particularly advantageous for highchairs that already have a tray attached so that the entire structure can be fit around the arm section and beneath the tray section. In addition, second side member 40 contains a seam 44 having a pair of mating fastening members to openably attach the respective sections of the seam to one another so that the entire side section can be opened to more conveniently fit the opening 42 through the arm of the highchair. Referring to the exposed view of FIG. 6, the mating sections of the fastening members are illustrated as 44A and 44B located on opposite sections of the highchair cover 10 at the location of seam 44. This is particularly advantageous for highchairs that already have a tray attached so that the entire structure can be fit around the arm section and beneath the tray section. The openable fastening members which are along seams 34 and 44 respectively can be any one of a multiplicity of different types of fastening members such as mating hook and loop (Velcro®) fasteners, mating snap fasteners, mating holes having buttons which fit therethrough, etc.

The one-piece cover highchair cover also comprises a center section 50 having a first opening 52 and a second opening 54 so that a fastening means such as a seatbelt or strap 60 can extend through openings 52 and 54 and be wrapped around the back of the highchair to retain the highchair cover on the highchair. In addition, the seatbelt also serves to enable to baby to be fastened in the highchair so that the baby will remain in the highchair while being fed.

Figure 7:
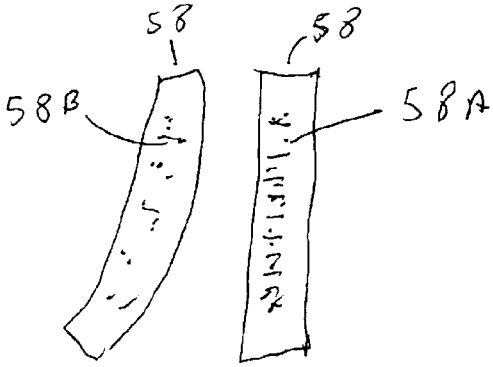
FIG. 7 is a cross-sectional view taken along Line 7—7 of FIG. 1.

The highchair cover 50 may also have a third opening 56 to accommodate the straddle bar which some modern highchairs have. By having the opening 56, the straddle bar can extend through the opening and the baby's legs can straddle the straddle bar. To further facilitate the accommodation of the straddle bar, beneath opening 56 is a seam 58. The seam is used to openably attach the cover over and around the straddle bar and thereafter, the sides of the seam 58 can be attached to one another. Referring to the exposed view of FIG. 7, the mating sections of the fastening members are illustrated as 58A and 58B located on opposite sections of the highchair cover 10 at the location of the seam 58. The openable fastening members along the seam 58 can be any one of a multiplicity of different types of fastening members such as mating hook and loop (Velcro®) fasteners, mating snap fasteners, mating holes having buttons which fit therethrough, etc.

The one-piece highchair cover also contains a top section 70 and a rear section 80 which fit over the top of the highchair and the back of the highchair as illustrated in FIGS. 1 through 3. The top also contains an opening 72 to further accommodate a shoulder belt to help retain the baby in the cover. Such shoulder belts are present in some current modern day highchairs and the opening 72 is designed to facilitate insertion of the shoulder belt through the opening 72 so that the baby can be further fastened to the seat cover and the highchair. The highchair is caused to remain in place on the top and back of the highchair cover by a stretchable fastening means 90 which by way of example, can be a belt or strap which is attached to respective ends of the rear portion of the side sections 30 and 40 of the highchair cover. In this way as illustrated in FIG. 2, the highchair cover is caused to remain on the highchair while the baby is being fed.

Therefore, through the various portions of the present invention, the highchair cover is caused to remain on the highchair while the baby can also be fastened to the highchair by means of the seatbelt 60 so that the baby can comfortably sit in the highchair and on the highchair cover and the highchair cover will remain in place and not fall off or expose any portion of the furniture item such as the highchair while the baby is being fed.

Figure 4:
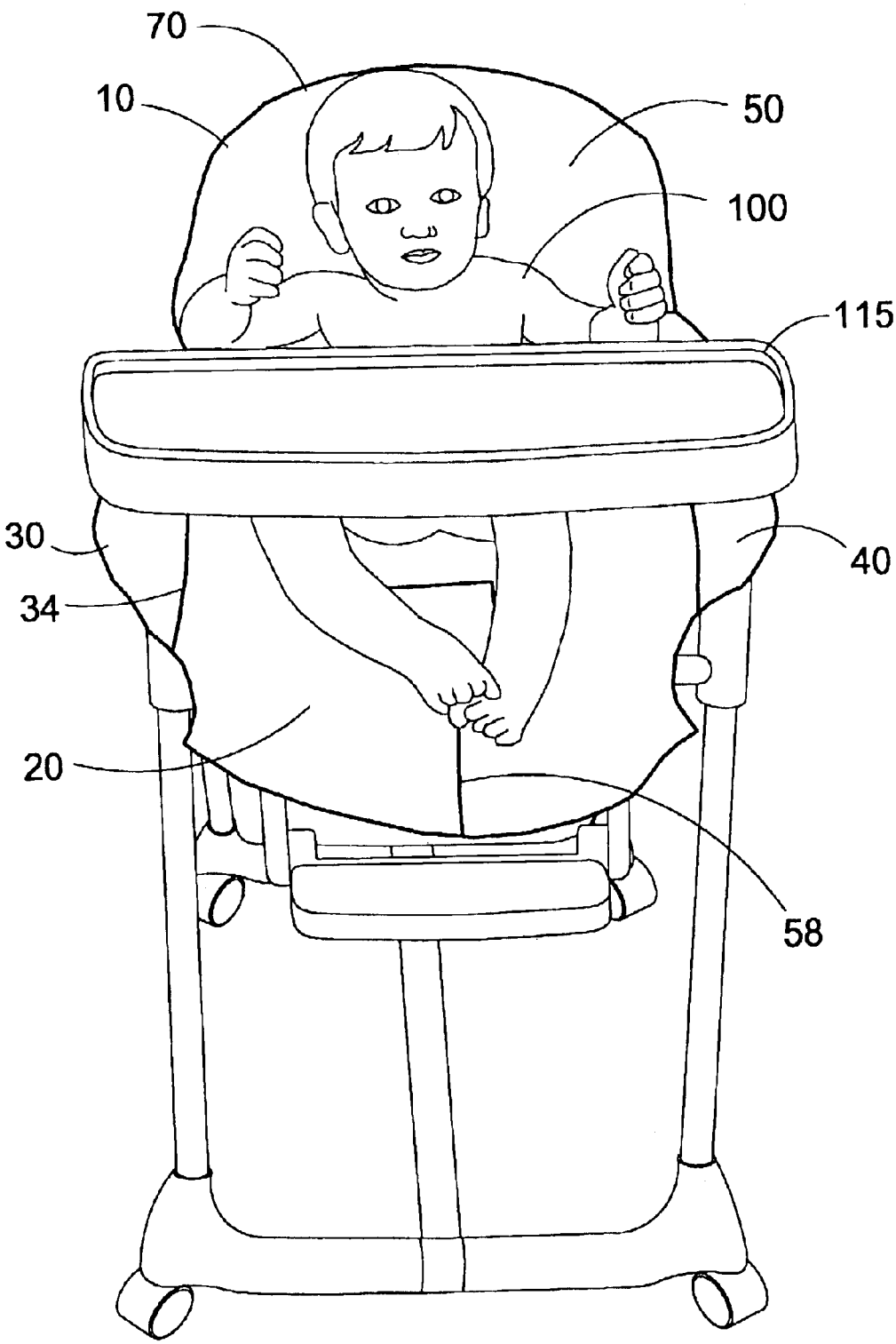
FIG. 4 is a front elevational view of the present invention highchair cover placed in its operational position on a highchair, and showing a baby seated on the highchair cover and a baby tray positioned in front of the baby.

FIG. 4 illustrates a front perspective view of the baby 100 sitting in the highchair with the highchair cover in place showing that the highchair cover completely covers the highchair while the baby is being fed so that the highchair cover will be protected during the feeding process.

Through use of the present invention, the highchair cover enables the highchair to be fully protected during the feeding process and assures that the highchair cover will not be moved away from a portion of the highchair or fall off the highchair while the baby is being fed. The incorporation of the seatbelt means which in addition to causing the highchair cover to remain on the highchair, also permits the baby to be fastened through the means of the seatbelt to the highchair cover, assures that the baby will be positioned appropriately in the highchair on the highchair cover during the feeding process.

Through use of the present invention, the highchair cover permits the highchair to be fully protected through a flexible stretchable covering material. By way of example, the highchair cover can be a very attractive royal blue color or any other color which will be visually attractive to the baby to further induce the baby to eat during the feeding process.

Because of the way the highchair cover is attached to the highchair, it can easily be removed after the feeding process is completed and can be easily cleaned and washed to be reused over and over again without fading and without shrinking so that it will be usable for a long time.

Defined in detail, the present invention is a cover for a highchair having a back, a top, a seat portion, two arms, interior and exterior sides and a straddle bar, the cover comprising: (a) a washable material made of one piece construction which fits entirely over the highchair; (b) the washable material having a lower portion which fits over the seat portion of the highchair and extends in front of the seat portion, the lower portion having an openable seam including a pair of mating fastener members which enable the lower portion of the material to be attached over and around the straddle bar; (c) the washable material further comprising a first side member having a first opening and a second side member having a second opening so that the side members fit over the arms of the highchair with a first arm of the highchair fitting through the first opening and a second arm of the highchair fitting through the second opening so that the side portions respectively cover both the interior and exterior sides of the highchair; (d) the first side member having an openable seam including a pair of mating fastening members to openably attach the respective sections of the seam to one another so the entire first side section is openable to more conveniently fit the first opening through an arm of the highchair; (e) the second side member having an openable seam including a pair of mating fastening members to openably attach the respective sections of the seam to one another so the entire second side section is openable to more conveniently fit the second opening through an arm of the highchair; (f) the washable material further comprising a center section having a first opening and a second opening to accommodate a fastening means to extend through the first and second openings and be wrapped around the back of the highchair, the center section having a third central opening to accommodate the straddle bar of the highchair; and (g) the washable material further comprising a top section and a rear section which respectively fit over the top of the highchair and the back of the highchair, the top section having an opening to accommodate a shoulder belt, the rear section having a stretchable fastening means to retain the top section and the rear section on the highchair.

Defined broadly, the present invention is a cover for a highchair having a back, a top, a seat portion, two arms, interior and exterior sides and a straddle bar, the cover comprising: (a) a material made of one piece construction which fits entirely over the highchair; (b) the material having a lower portion which fits over the seat portion of the highchair and extends in front of the seat portion, the lower portion having an openable seam including a pair of mating fastener members which enable the lower portion of the material to be attached over and around the straddle bar; (c) the material further comprising a first side member having a first opening and a second side member having a second opening so that the side members fit over the arms of the highchair with a first arm of the highchair fitting through the first opening and a second arm of the highchair fitting through the second opening so that the side portions respectively cover both the interior and exterior sides of the highchair; (d) the first side member having an openable seam including a pair of mating fastening members to openably attach the respective sections of the seam to one another so the entire first side section is openable to more conveniently fit the first opening through an arm of the highchair; (e) the second side member having an openable seam including a pair of mating fastening members to openably attach the respective sections of the seam to one another so the entire second side section is openable to more conveniently fit the second opening through an arm of the highchair; (e the material further comprising a center section having a first opening and a second opening to accommodate a fastening means to extend through the first and second openings and be wrapped around the back of the highchair, the center section having a third central opening to accommodate the straddle bar of the highchair; and (g) the material further comprising a top section and a rear section which respectively fit over the top of the highchair and the back of the highchair, the top section having an opening to accommodate a shoulder belt, the rear section having a stretchable fastening means to retain the top section and the rear section on the highchair.

Defined more broadly, the present invention is a cover for a highchair having a back, a top, a seat portion, two arms, and interior and exterior sides, the cover comprising: (a) a material made of one piece construction which fits over the highchair; (b) the material having a lower portion which fits over the seat portion of the highchair and extends in front of the seat portion; (c) the material further comprising a first side member having a first opening and a second side member having a second opening so that the side members fit over the arms of the highchair with a first arm of the highchair fitting through the first opening and a second arm of the highchair fitting through the second opening so that the side portions respectively cover both the interior and exterior sides of the highchair; (d) the first side member having an openable seam including a pair of mating fastening members to openably attach the respective sections of the seam to one another so the entire first side section is openable to more conveniently fit the first opening through an arm of the highchair; (e) the second side member having an openable seam including a pair of mating fastening members to openably attach the respective sections of the seam to one another so the entire second side section is openable to more conveniently fit the second opening through an arm of the highchair; (f) the material further comprising a center section having a first opening and a second opening to accommodate a fastening means to extend through the first and second openings and be wrapped around the back of the highchair; and (g) the material further comprising a top section and a rear section which respectively fit over the top of the highchair and the back of the highchair, the rear section having a stretchable fastening means to retain the top section and the rear section on the highchair.

Defined even more broadly, the present invention is a cover for a highchair having a back, a top, a seat portion, two arms, and interior and exterior sides, the cover comprising: (a) a material made of one piece construction which fits over the highchair; (b) the material having a lower portion which fits over the seat portion of the highchair and extends in front of the seat portion; (c) the material further comprising a first side member having a first opening and a second side member having a second opening so that the side members fit over the arms of the highchair with a first arm of the highchair fitting through the first opening and a second arm of the highchair fitting through the second opening so that the side portions respectively cover both the interior and exterior sides of the highchair; (d) the material further comprising a center section having a first opening and a second opening to accommodate a fastening means to extend through the first and second openings and be wrapped around the back of the highchair; and (e) the material further comprising a top section and a rear section which respectively fit over the top of the highchair and the back of the highchair, the rear section having a stretchable fastening means to retain the top section and the rear section on the highchair.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A cover for a highchair having a back, a top, a seat portion, two arms, interior and exterior sides and a straddle bar on which cover an infant is seated, the cover comprising:

a. a washable material made of one piece construction which fits entirely over the highchair to completely cover the back, the top, the seat portion, both of the two arms, and the interior and exterior sides;

b. the washable material having a lower portion which fits over the seat portion of the highchair and extends in front of the seat portion, the lower portion having an openable seam including a pair of mating fastener members which enable the lower portion of the material to be attached over and around the straddle bar;

c. the washable material further comprising a first side member having a first opening and a second side member having a second opening so that the side members fit over the arms of the highchair with a first arm of the highchair fitting through said first opening and a second arm of the highchair fitting through said second opening so that the side portions respectively cover both the interior and exterior sides of the highchair;

d. said first side member having opposing sections along which is located an openable seam including a pair of mating fastening members to openably attach the respective sections of the seam to one another so the entire first side section is openable to more conveniently fit an arm of the highchair through the opening;

e. said second side member having opposing sections along which is located an openable seam including a pair of mating fastening members to openably attach the respective sections of the seam to one another so the entire second side section is openable to more conveniently fit an arm of the highchair through the opening;

f. said washable material further comprising a center section having a first opening and a second opening to accommodate a seatbelt to extend through the first and second openings and be wrapped around the back of the highchair to retain the infant in the highchair, the center section having a third central opening to accommodate the straddle bar of the highchair; and g. said washable material further comprising a top section and a rear section which respectively fit over the top of the highchair and the back of the highchair, the top section having an opening to accommodate a shoulder belt, the rear section having a stretchable fastening means to retain the top section and the rear section on the highchair.

2. The cover in accordance with claim 1, wherein said washable material is synthetic material selected from the group comprising neoprene, nylon and polyester.

3. The cover in accordance with claim 1, wherein said washable material is cotton.

4. The cover in accordance with claim 1, wherein each of said mating fastening members are hook and loop fasteners.

5. A cover for a highchair having a back, a top, a seat portion, two arms, interior and exterior sides and a straddle bar on which cover an infant is seated, the cover comprising:

a. a material made of one piece construction which fits entirely over the highchair to completely cover the back, the seat portion both of the two arms, and the interior and exterior sides;

b. the material having a lower portion which fits over the seat portion of the highchair and extends in front of the seat portion, the lower portion having an openable seam including a pair of mating fastener members which enable the lower portion of the material to be attached over and around the straddle bar;

c. the material further comprising a first side member having a first opening and a second side member having a second opening so that the side members fit over the arms of the highchair with a first arm of the highchair fitting through said first opening and a second arm of the highchair fitting through said second opening so that the side portions respectively cover both the interior and exterior sides of the highchair;

d. said first side member having opposing sections along which is located an openable seam including a pair of mating fastening members to openably attach the respective sections of the seam to one another so the entire first side section is openable to more conveniently fit an arm of the highchair through the opening;

e. said second side member having opposing sections along which is located an openable seam including a pair of mating fastening members to openably attach the respective sections of the seam to one another so the entire second side section is openable to more conveniently fit an arm of the highchair through the opening;

f. said material further comprising a center section having a first opening and a second opening to accommodate a seatbelt to extend through the first and second openings and be wrapped around the back of the highchair to retain the infant in the highchair, the center section having a third central opening to accommodate the straddle bar of the highchair; and g. said material further comprising a top section and a rear section which respectively fit over the top of the highchair and the back of the highchair, the top section having an opening to accommodate a shoulder belt, the rear section having a stretchable fastening means to retain the top section and the rear section on the highchair.

6. The cover in accordance with claim 5, wherein said material is synthetic material selected from the group comprising neoprene, nylon and polyester.

7. The cover in accordance with claim 5, wherein said material is cotton.

8. The cover in accordance with claim 5, wherein each of said mating fastening members are hook and loop fasteners.

9. A cover for a highchair having a back, a top, a seat, portion, two arms, and interior and exterior sides on which an infant is seated, the cover comprising:

a. a material made of one piece construction which fits over the highchair to completely cover the back, the top, the seat portion, both of the two arms, and the interior and exterior sides;

b. the material having a lower portion which fits over the seat portion of the highchair and extends in front of the seat portion;

c. the material further comprising a first side member having a first opening and a second side member having a second opening so that the side members fit over the arms of the highchair with a first arm of the highchair fitting through said first opening and a second arm of the highchair fitting through said second opening so that the side portions respectively cover both the interior and exterior sides of the highchair;

d. said first side member having opposing sections along which is located an openable seam including a pair of mating fastening members to openably attach the respective sections of the seam to one another so the entire first side section is openable to more conveniently fit an arm of the highchair through the opening;

e. said second side member having opposing sections along which is located an openable seam including a pair of mating fastening members to openably attach the respective sections of the seam to one another so the entire second side section is openable to more conveniently fit an arm of the highchair through the opening;

f. said material further comprising a center section having a first opening and a second opening to accommodate a seatbelt to extend through the first and second openings and be wrapped around the back of the highchair to retain the infant in the highchair; and g. said material further comprising a top section and a rear section which respectively fit over the top of the highchair and the back of the highchair, the rear section having a stretchable fastening means to retain the top section and the rear section on the highchair.

10. The cover in accordance with claim 9, wherein said material is synthetic material selected from the group comprising neoprene, nylon and polyester.

11. The cover in accordance with claim 9, wherein said material is cotton.

12. The cover in accordance with claim 9, wherein each of said mating fastening members are hook and loop fasteners.

13. A cover for a highchair having a back, a top, a seat portion, two arms, and interior and exterior sides on which cover an infant is seated, the cover comprising:

a. a material made of one piece construction which fits over the highchair to completely cover the back, the top, the seat portion, both of the two arms, and the interior and exterior sides;

b. the material having a lower portion which fits over the seat portion of the highchair and extends in front of the seat portion;

c. the material further comprising a first side member having a first opening and a second side member having a second opening so that the side members fit over the arms of the highchair with a first arm of the highchair fitting through said first opening and a second arm of the highchair fitting through said second opening so that the side portions respectively cover both the interior and exterior sides of the highchair;

d. said material further comprising a center section having a first opening and a second opening to accommodate a seatbelt to extend through the first and second openings and be wrapped around the back of the highchair to retain the infant in the highchair; and f. said material further comprising a top section and a rear section which respectively fit over the top of the highchair and the back of the highchair, the rear section having a stretchable fastening means to retain the top section and the rear section on the highchair.

14. The cover in accordance with claim 13, wherein said material is synthetic material selected from the group comprising neoprene, nylon and polyester.

15. The cover in accordance with claim 13, wherein said material is cotton.

16. The cover in accordance with claim 13, wherein each of said mating fastening members are hook and loop fasteners.

* * * * *